US006308837B1

(12) United States Patent
Bragg et al.

(10) Patent No.: US 6,308,837 B1
(45) Date of Patent: Oct. 30, 2001

(54) RACK FOR HOLDING PILLOWS

(76) Inventors: Elizabeth A. Bragg; Leath A. Sutton, both of P.O. Box 337, Smarr, GA (US) 31086

( * ) Notice: Subject to any disclaimer, the term of this patent is extended or adjusted under 35 U.S.C. 154(b) by 0 days.

(21) Appl. No.: 09/510,714

(22) Filed: Feb. 22, 2000

(51) Int. Cl.[7] ..... A47F 7/00

(52) U.S. Cl. ..... 211/13.1; 211/85.7; 211/113

(58) Field of Search ..... 211/113, 115, 211/116–118, 13.1, 119.006, 88.01; 248/693, 176.1, 215, 317, 327, 339; 5/120, 129; D6/382, 386, 387

(56) References Cited

U.S. PATENT DOCUMENTS

| | | | | |
|---|---|---|---|---|
| D. 278,497 | * | 4/1985 | Walpin | D6/462 |
| D. 278,669 | * | 5/1985 | Walpin | D6/462 |
| D. 336,378 | * | 6/1993 | Kittridge | D6/387 |
| D. 423,857 | * | 5/2000 | Shea | D6/566 |
| 3,063,570 | * | 11/1962 | Kroner | 211/113 |
| 4,015,719 | * | 4/1977 | Hanopole . | |
| 4,227,669 | * | 10/1980 | McInnis | 211/113 |
| 4,295,432 | * | 10/1981 | Hulke | 108/149 |
| 4,329,789 | * | 5/1982 | Erickson | 211/113 |
| 4,520,979 | * | 6/1985 | McInnis | 248/317 |
| 4,523,526 | * | 6/1985 | O'Neill | 211/113 |
| 4,664,266 | * | 5/1987 | Fausett et al. | 211/87.01 |
| 4,765,495 | * | 8/1988 | Bisk | 211/113 |
| 4,830,199 | * | 5/1989 | Wolfe et al. | 211/86 |
| 5,115,525 | * | 5/1992 | Lovitt | 5/120 |
| 5,542,530 | * | 8/1996 | Freelander | 211/117 |
| 5,553,719 | * | 9/1996 | Campbell | 211/113 |
| 5,718,343 | * | 2/1998 | Belokin et al. | 211/118 |
| 5,813,548 | * | 9/1998 | Jiang | 211/113 |
| 6,119,873 | * | 9/2000 | Matthews | 211/49.1 |
| 6,138,841 | * | 10/2000 | Klein et al. | 211/85.7 |
| 6,158,593 | * | 12/2000 | Olsen | 211/85.7 |

* cited by examiner

*Primary Examiner*—Jerry Redman
*Assistant Examiner*—Jennifer E. Novosad

(57) ABSTRACT

Pillow holding devices made from a variety of materials that can be used as pieces of furniture, can be attached to or hung on many objects or surfaces and can hold not only pillows, but other bedding and accessory items.

1 Claim, 7 Drawing Sheets

RACK FOR HOLDING PILLOWS

BACKGROUND OF THE INVENTION

There have been past attempts to provide holders for bedding. See the disclosures in the following U.S. Pat. Nos.

U.S. Pat. No. 5,652,976

U.S. Pat. No. 5,699,565

U.S. Pat. No. 5,509,158

U.S. Pat. No. 5,774,913

U.S. Pat. No. 5,001,795

U.S. Pat. No. 5,946,751

U.S. Pat. No. 5,754,996

U.S. Pat. No. D327,589

U.S. Pat. No. D335,399

A review of these bedding holders reveal that they are either attached to a bed, fit between a mattress and box spring, fit under a bed or add new design to the traditional blanket or quilt racks and further, are basically designed for bedding. Therefore, there is a need to take into account the large number of decorative pillows used on beds, sofas and chairs in recent times and the recurring problem of temporary storage of these pillows when they must be removed when using beds, sofas or chairs. It is evident that a need remains for provision of a means of holding decorative pillows. The invention disclosed herein solves this and related problems.

SUMMARY OF INVENTION

In recent times large quantities of pillows are known to be used as a decorating element in not only bedrooms but living rooms, family rooms, great rooms and dens to enhance the aesthetic value of beds, sofas and chairs. This invention relates to pillow holders for decorative pillows. It is the primary objective of this invention to provide temporary holding devices for pillows when not being used for decorative purposes on beds, sofas and chairs. Many pillows are made from expensive fabrics which, can be damaged without proper care. It is also the objective of this invention to provide holders for pillows to avoid placing the pillows on the floor when using beds, sofas and chairs. When placed on the floor, pillows can get wrinkled or soiled, obstruct a walking path or pose a safety hazard to someone tripping over them. A recurring problem for users of particularly beds and often sofas and chairs involves temporary storage of decorative pillows. The necessity of temporary storage of pillows is common as many pillows are for decorative use only and must be removed when using the beds, sofas or chairs.

In terms of broad inclusion, the invention described and illustrated herein comprises devices holding decorative pillows when beds sofas and chairs are being used. Applications may include, but are not limited to, use for pillows, blankets, spreads, quilts sofa throws, comforters and sheets as well as other accessories.

Having now described this invention, it will be apparent that many changes and modifications can be made by anyone of ordinary skill so as not to depart from the spirit and scope of this invention as defined in the claims.

DETAILED DESCRIPTION OF THE INVENTION

The following descriptions of the present invention detail not only the articles or devices but also the method for use. This invention is subject to embodiments of many different forms. The drawings and descriptions of the invention are to be considered as examples of the principles of the invention and are not intended to limit the broad aspects of the invention to the embodiments illustrated and described. These articles or devices present simple solutions for a recent problem of where to place decorative pillows when using the articles of furniture on which they are placed. Furthermore, these articles or devices can be made of rigid or flexible materials that coordinate with the room decor.

Figure 1A:
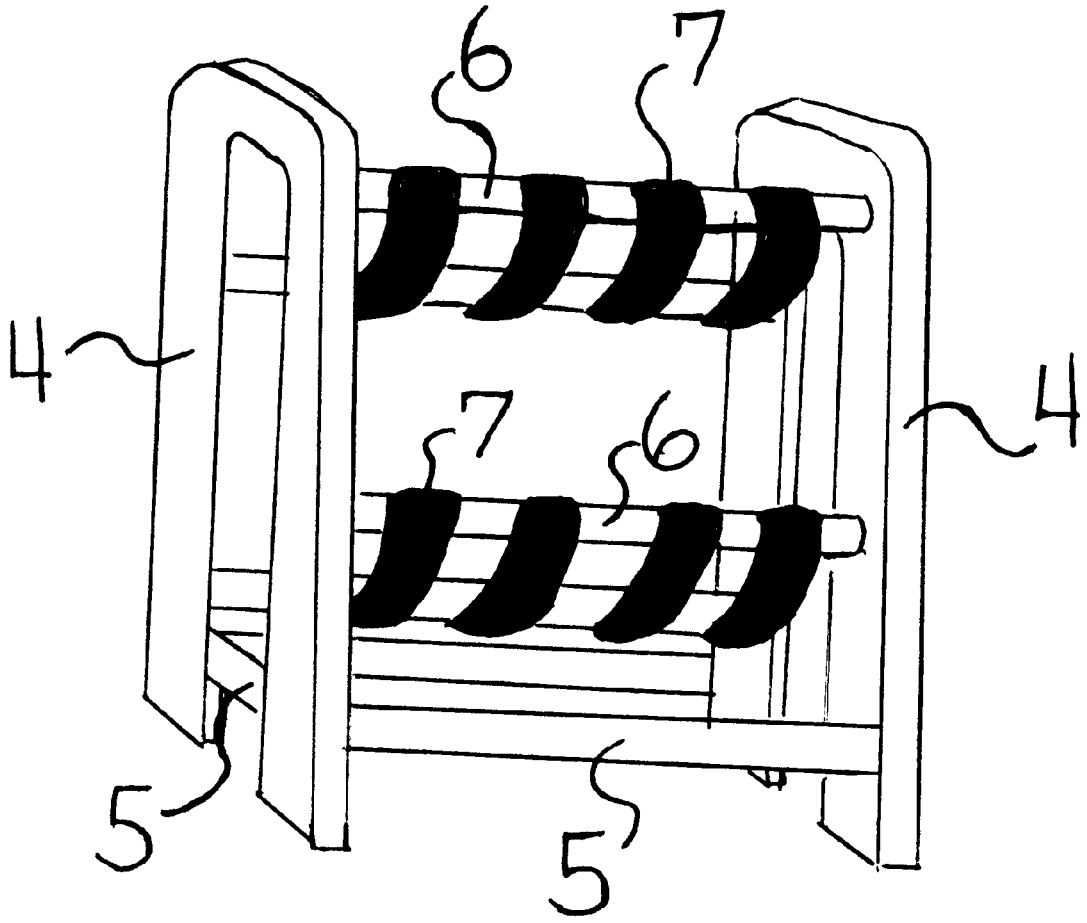
FIG. 1*a*: is a perspective view of one embodiment according to the present invention.
Figure 1B:
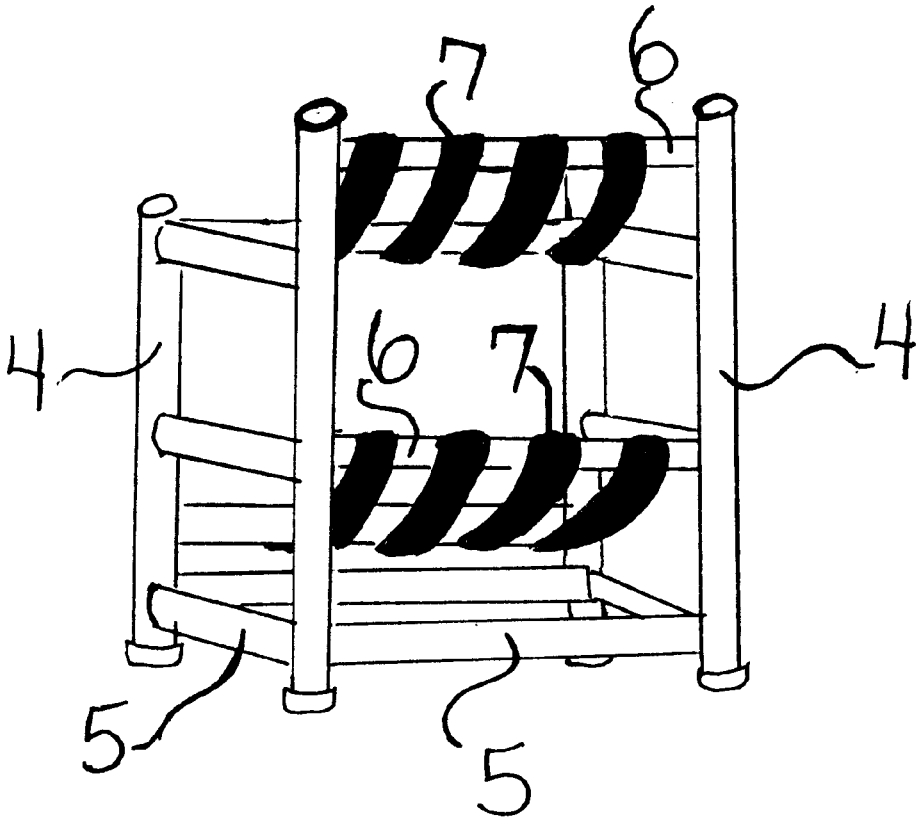
FIG. 1*b*: is a perspective view of a second embodiment according to the present invention.
Figure 1C:
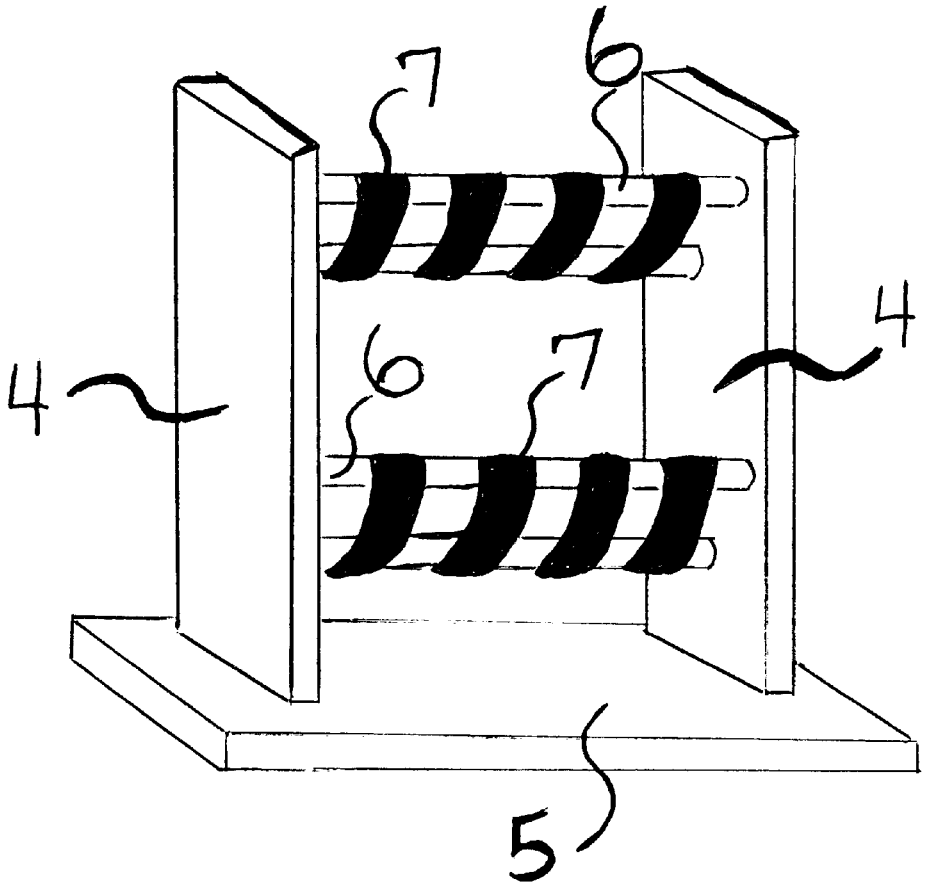
FIG. 1*c*: is a perspective view of a third embodiment according to the present invention.

FIG. 1: illustrates in perspective similar articles of furniture for holding pillows. In its broadest context, the articles consist of support frames of rigid material (wood, wood substitutes, metal and plastic etc.) with horizontal support bases of said rigid material with the purpose of holding strips of flexible material (cloth, elastic, leather and plastic etc.) forming an expandable support system for holding pillows. To use, simply place or stack pillows on the horizontal support system. An additional use could be the placement of blankets, spreads, quilts, sofa throws, comforters and sheets either folded and stacked on the support system or unfolded and draped over the top support system.

Numerical description of various aspects of embodiments of the articles of furniture:

4—vertical side support system

5—horizontal support apparatuses

6—dual horizontal support bases

7—strips of flexible material

Figure 2:
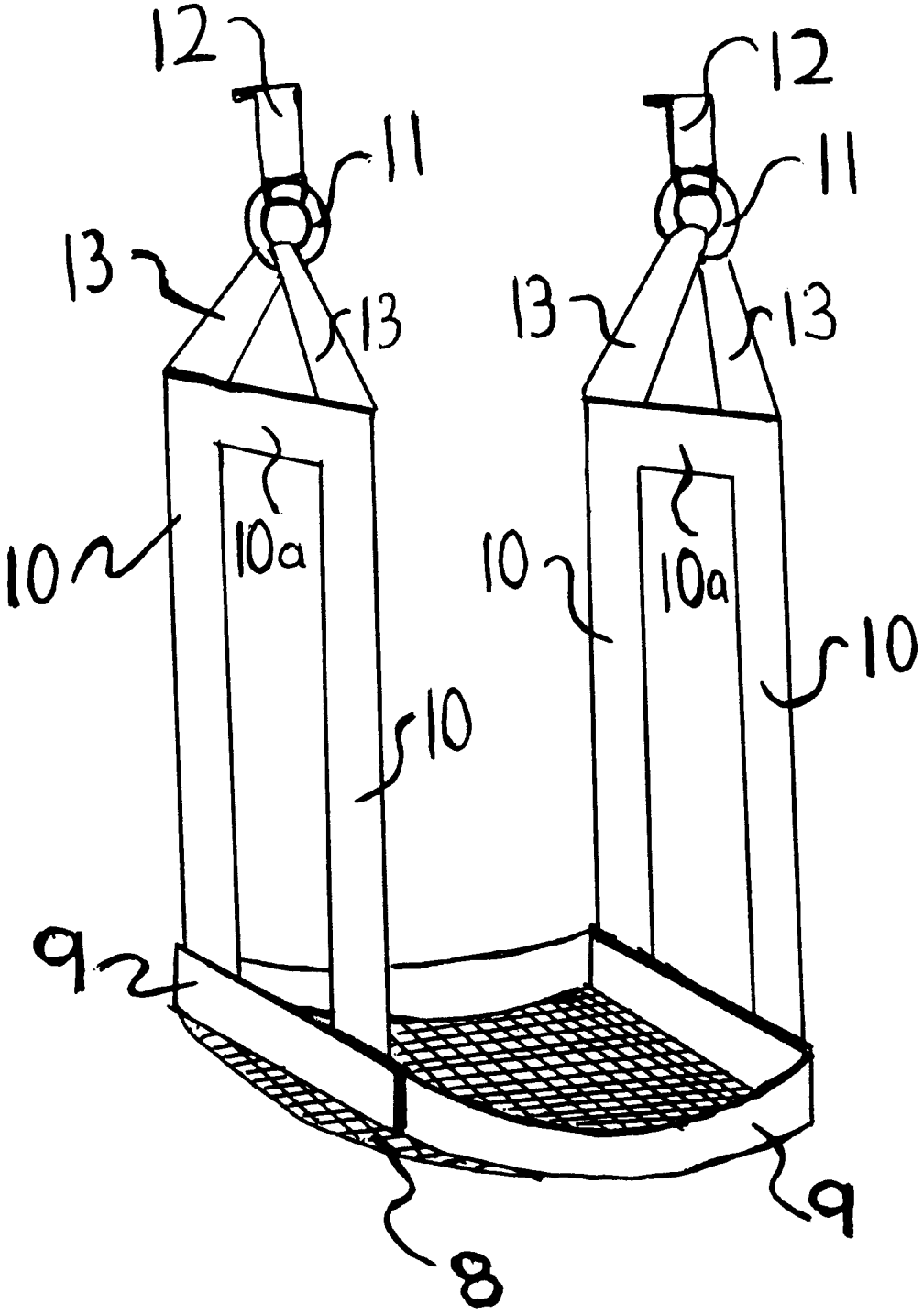
FIG. 2: is a perspective view of one embodiment according to the present invention.

FIG. 2: illustrates in perspective a removable attachable device for holding pillows. In its broadest context, the device consists of a holding surface of resilient material (net or a variety of fabrics), a perimeter frame of adjustable flexible material with upright connections for attaching to a multitude of surfaces or objects; such as, ceilings, walls, over doors or in closets. This article can be manufactured in total by the use of a sewing machine. To adjust the article a hook-and-loop type fastener such as that which is marketed under the VELCRO trademark can be used.

To use, simply place or stack pillows on the base holding surface. An additional use could be the placement of folded bedding items or sofa throws. When not in use the device is collapsible.

Numerical description of attachable holding device:

8—base holding surface or wall

9—perimeter frame or side walls

(8, 9)—base structure

10—upright connections defining arms

10*a*—crosspieces

11—attachment fasteners or suspension members

12—attachment fasteners or suspension members

13—upper members

**(10,10*a*, 13)**—side supports

Figure 3A:
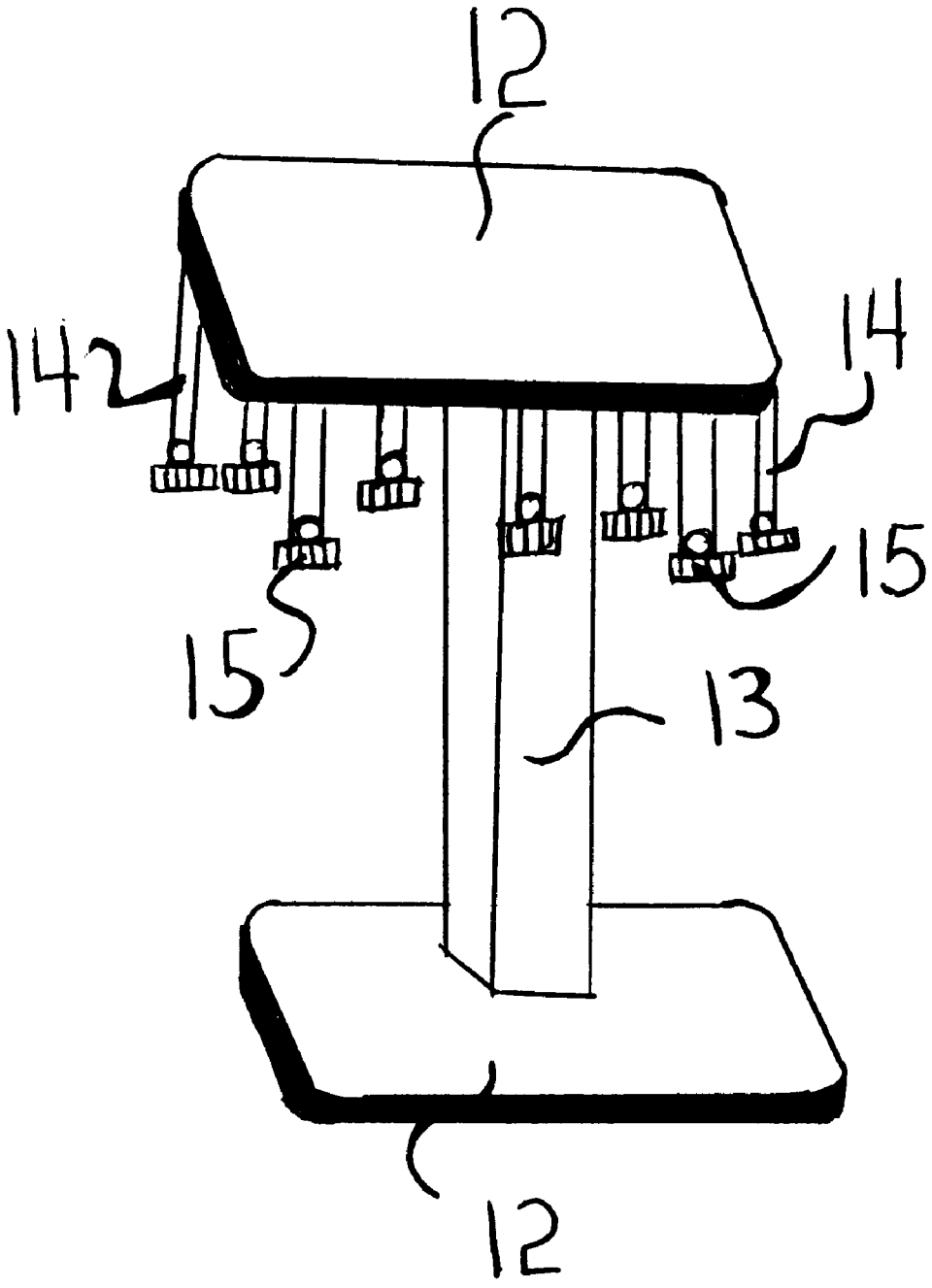
FIG. 3*a*: is a perspective view of one embodiment according to the present invention.
Figure 3B:
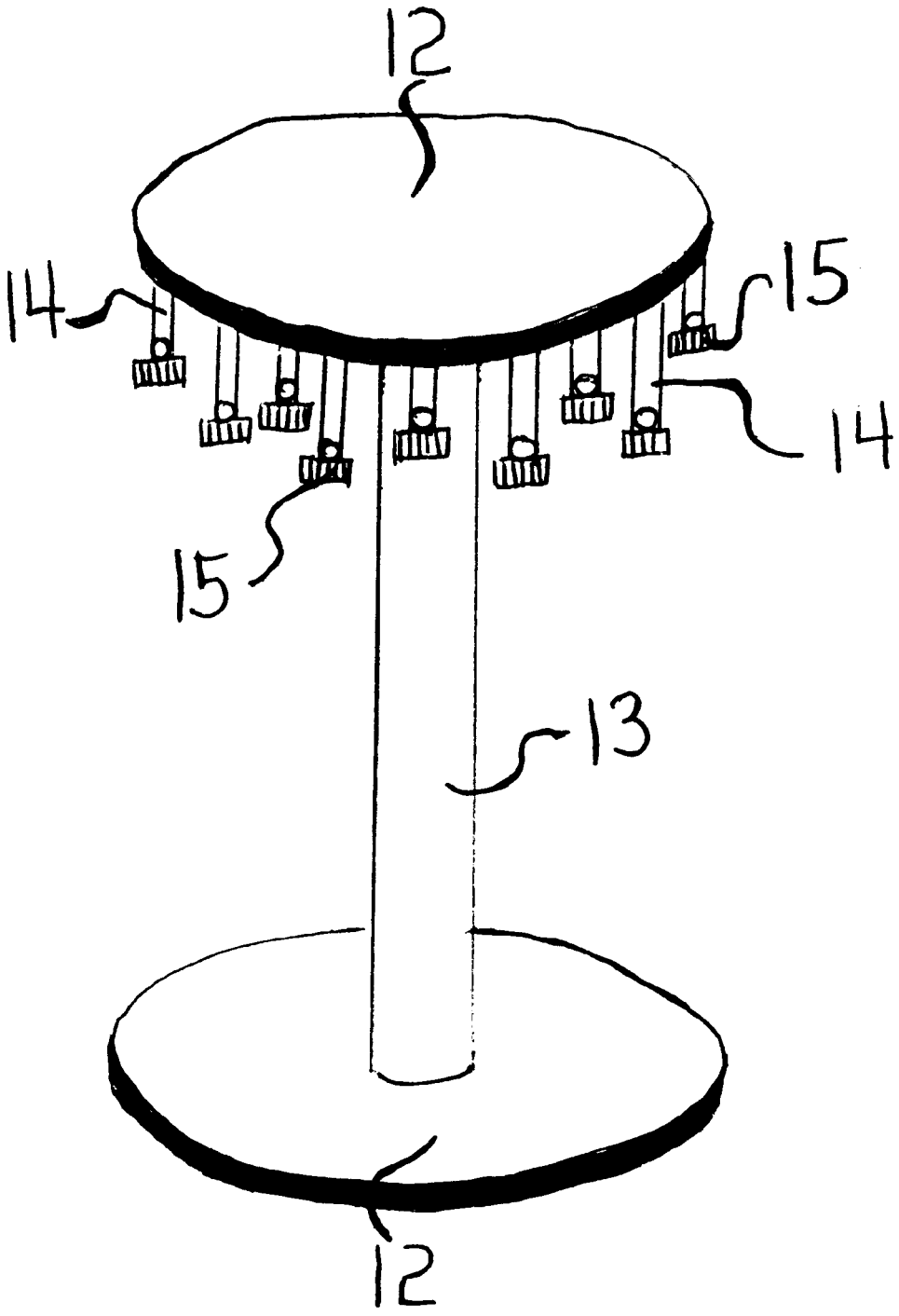
FIG. 3*b*: is a perspective view of a second embodiment according to the present invention.
Figure 3C:
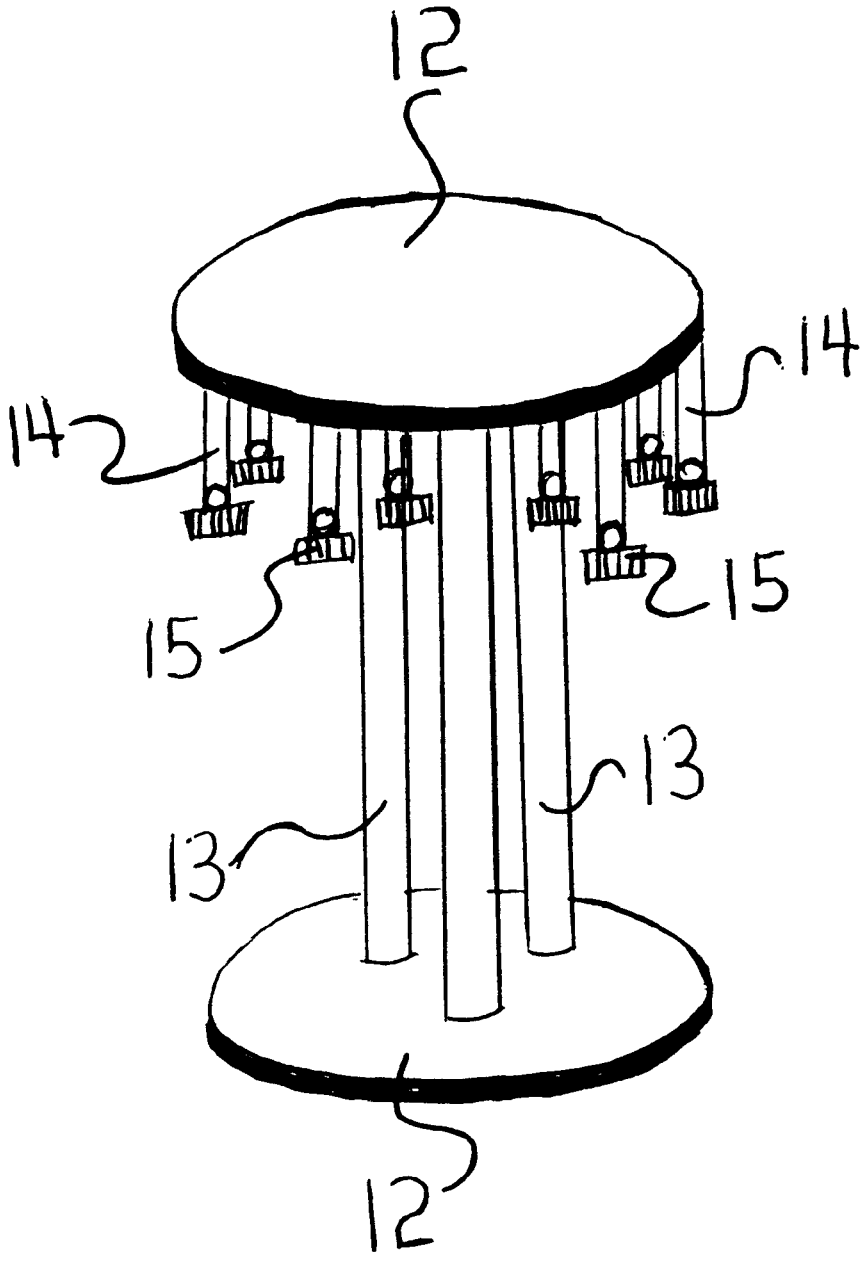
FIG. 3*c*: Is a perspective view of a third embodiment according to the present invention.

FIG. 3: illustrates in perspective an article of furniture for holding pillows with several subtle variations. In its broadest context, the article consists of top and bottom horizontal bases of rigid material (wood, wood substitutes and plastics etc.) a single or plurality of strips or rounds of rigid material forming vertical support, and flexible material strips or rounds with fasteners attached at extremities for attaching and removing pillows.

To use simply hang pillows, bedding or sofa throws using fasteners attached to flexible material strips or rounds. Also, folded bedding or sofa throws could be placed on top horizontal base. In addition the following accessory items could be placed on the top horizontal base: lamps, collectibles, books, candles, plants, pictures, etc. Because this article of furniture takes up little space it is ideal for use in corners, beside other pieces of furniture, and may be placed in closets.

Numerical description of various aspects of the article of furniture:

12—top and bottom bases

13 vertical support, supports

14—flexible material strips or rounds, attached with staples, screws, nails, etc.

15—clothes pin type fasteners to hold pillows

The foregoing drawings and descriptions are to be considered as illustrative only of the principles of this invention. Numerous modifications, variations, changes and uses will be readily apparent and obvious to those skilled in the art, and are intended to be encompassed by the present invention. Therefore, all suitable modifications and equivalents may be resorted to as long as they fall within the scope of this invention.

What is claimed is:

1. A collapsible rack for holding pillows comprising:

(a) two side supports, each of the supports comprising (i) an inverted generally U-shaped lower member, made from fabric, and having a pair of arms (10) connected together at one end by a crosspiece **(10*a*), and (ii) an inverted generally V-shaped upper member (13), made from fabric, and having a pair of ends connected to ends of the crosspiece, (iii) a suspension member (11, 12) comprising a circular loop, attached to the upper member (13), (b) a substantially rectangular base structure comprising a perimeter frame defined by four side walls (9) made of a flexible material and a base wall (8) made of resilient netting material to allow airflow therethrough, whereby a non-compartmentalized interior space is defined between the side walls and base wall, wherein ends of the arms (10)** opposite to the crosspieces are attached at corner portions of the base structure, wherein the support is convertible between a first extended position whereby the rack can be suspended from a supporting structure with the side supports extending substantially perpendicular to the base structure thereby allowing pillows to be stacked within the interior space and between the side supports, and a second collapsed position whereby the vertical supports and the base structure can be folded together in a flat position.

* * * * *